US005775835A

United States Patent [19]

Szekely

[11] Patent Number: 5,775,835

[45] Date of Patent: Jul. 7, 1998

[54] EMBEDMENT TILES FOR PEDESTRIAN PLATFORMS AND WALKWAYS

[76] Inventor: Kenneth E. J. Szekely, 5 Third Line, Oakville, Ontario, Canada, L6L 3Z3

[21] Appl. No.: 548,914

[22] Filed: Oct. 26, 1995

[51] Int. Cl.[6] ..... E04F 15/10

[52] U.S. Cl. ..... 404/34; 404/42; 404/44; 116/205; 116/DIG. 17; 104/30

[58] Field of Search ..... 404/9, 15, 19, 404/28, 29, 32, 33, 35, 36, 42, 43, 44; 116/205, DIG. 17; 104/30

[56] References Cited

U.S. PATENT DOCUMENTS 3,950,908 4/1976 Van Eyk ..... 404/33 X
5,281,459 1/1994 Van Eijck ..... 404/33 X

*Primary Examiner*—James Lisehora
*Attorney, Agent, or Firm*—James W. Carson

[57] ABSTRACT

The present invention provides a textured tile for embedment in fresh concrete on a platform or walking surface comprising a generally planer element with an upper surface and a lower surface, said upper surface having a plurality of upper projections therefrom to provide a distinctive texture relative to the surface of the platform or walkway, said tile having two opposite side edges intended for alignment with corresponding side edges of other tiles, front and rear edges at least one of which faces oncoming pedestrian traffic. Vertical depending flanges are provided along said opposite side edges and said front and rear edges. There is a plurality of holes in said depending flanges and a series of projections depending from the lower surface of the generally planer element.

7 Claims, 7 Drawing Sheets

EMBEDMENT TILES FOR PEDESTRIAN PLATFORMS AND WALKWAYS

BACKGROUND OF THE INVENTION

1. Field of the Invention

The present invention relates generally to pedestrian platforms, walkways and sidewalks and the like and specifically to textured tiles which assist pedestrians, particularly those who are blind or visually impaired, in following a walkway or in detecting the location of a sidewalk edge, platform edge or other similar hazard.

2. Description of the Prior Art

In public transit facilities, for example, such as subway stations and railway stations, there is often a need for pedestrians to detect the location of the platform edges so that the pedestrian does not accidentally walk off the edge of the platform. The need for making such walkways and platform edges detectable is, of course, particularly acute in attempting to make such facilities accessible and safe for blind or visually impaired persons.

The need to indicate the locations of hazards applies not only to public transit facilities, but also to loading docks, stages, speaking platforms, stairways, sidewalks, curb ramps, crosswalks and roadway crossings, etc.

In many public transportation systems, passenger traffic is increasing. A concomitant societal commitment to increasing access to public facilities has increased the independent mobility of persons traditionally believed to be physically disabled. Thus, there is an increased need for means to indicate to pedestrians the locations of walkways and the vicinity of the edge of platforms.

In the mid 1960's, a Japanese inventor developed a precast brightly coloured concrete block with parallel rows of raised domes on its upper surface. It was proposed that by lining the platform edge or other hazard with these "braille blocks" the platform edge would be detectable by the visually impaired either by the long cane or underfoot. The blocks were subsequently constructed in a variety of shapes and sizes and from a variety of materials including ceramic, aluminum, synthetic rubber (hard), synthetic rubber (soft), poly vinyl chloride (pvc), reinforced thermoplastics and various combinations of same.

In the 1980's a series of studies were undertaken in the United States to improve the design of buildings and transportation facilities to improve the mobility of the visually impaired. These studies culminated in recommendations on making potential hazards detectable to the visually impaired either by the use of the long cane or underfoot.

*Americans with Disabilities Act (ADA): Accessibility Guidelines for Buildings and Facilities* set the requirements for the use of detectable warnings at curb ramps, walking surfaces, transit platforms and the like to warn visually impaired people of hazards. The Guidelines require that detectable warnings shall consist of raised truncated domes with a diameter of nominal 0.9" (23 mm), a height of nominal 0.2" (5 mm) and a centre-to-centre spacing of nominal 2.35" (60 mm) and shall contrast visually with adjoining surfaces, either light on dark or dark on light. The material used to provide contrast shall be an integral part of the walking surface. Detectable warnings used on interior surfaces are required to differ from adjoining surfaces in resiliency or sound-on-cane contact. Platform edges bordering a drop off and not protected by screens or guard rails shall have a detectable warning 24 inches wide running the full length of the platform drop off. If a walkway crosses or adjoins a vehicular way, and the walking surface is not separated by curbs, railings or other elements between the pedestrian areas and the vehicular areas, the boundary between such areas is to be defined by a continuous detectable warning 36 inches wide. Curb ramps are also required to have detectable warnings extending the full width and depth of the curb ramp.

Various tactile tiles having raised truncated domes in compliance with the ADA Guidelines or the equivalent have been developed, such as those shown in U.S. Pat. No. 4,715,743 (Schmanski) and U.S. Pat. No. 5,303,669 (Szekely). The majority of these tactile tiles are designed to be glued or mechanically fastened to the existing walking surface. Such tiles suffer from a number of potential drawbacks, including the need for intensive labour to properly install tiles. In both indoor and outdoor applications, where adhesives are used, there is a tendency for the tiles to peel from the floor after a period of time and to potentially create a tripping hazard. Other tactile surfaces have been proposed such as the rubber on concrete composite tile illustrated in Netherlands Patent 8600855.

U.S. Pat. No. 5,303,669 describes a detectable tactile tile that is intended to be installed in concrete or the like. The tiles are illustrated as square with depending flanges projecting downward from the edge of the tile. The flanges have holes through them to assist in anchoring the tile in freshly poured concrete. The holes in the flanges around the perimeter of the tiles permit air to flow out from under the tiles when they are pressed into the concrete. However it is virtually impossible to remove all of the air and there is typically an air space between the bottom surface of the tile and the top of the cured concrete. When baggage carts, money carts with small wheels or heavy mechanical equipment either for cleaning, snow removal etc. passes over the tiles, there may be a tendency for the tiles to crack under the weight of the equipment, due to the air space between tiles and the concrete surface.

SUMMARY OF THE INVENTION

It is the object of the present invention to provide tiles which can be embedded in freshly poured concrete at a walking surface or cast in concrete to prefabricate pavers, i.e. concrete tiles with the tile of the invention incorporated into the upper surface so the warning area can be provided simply by laying down one or more rows of these pavers in appropriate locations.

It is the further object of the present invention to provide an improved embedment tile which when embedded in concrete will permit baggage carts, money carts or heavy mechanical equipment to be moved across the tiles to either clean, remove snow or transport cargo without the tiles cracking.

Accordingly, the present invention provides a textured tile for embedment in fresh concrete on a platform or walking surface comprising a generally planer element with an upper surface and a lower surface, said upper surface having a plurality of upper projections therefrom to provide a distinctive texture relative to the surface of the platform or walkway, said tile having two opposite side edges intended for alignment with corresponding side edges of other tiles, front and rear edges at least one of which faces oncoming pedestrian traffic. Vertical depending flanges are provided along said opposite side edges and said front and rear edges. There is a plurality of holes in said depending flanges and a series of projections depending from the lower surface of the generally planer element.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

The tiles of the present invention are intended to be used as a detectable warning at drop-offs, curb ramps, etc. and a wayfinding tile in compliance with the ADA Accessibility Guidelines. While the following description refers to the use of the tiles of the present invention as a detectable warning embedded in the surface of a transit platform and at a curb ramp, it should be apparent that the tiles can be applied to any area where a detectable warning is desired or required including loading docks, stages, speaking platforms, stairway tops, landings, docks, pools, piers, steep slopes and restricted or hazardous areas of any kind not just platforms having a vertical drop-off. In addition tiles according to the present invention can be used as directional or wayfinding tiles by changing the tactile pattern on the top surface from rows of truncated domes to the raised bars as described for example in U.S. Pat. Nos. 5,303,669 and 4,715,743.

Figure 1:
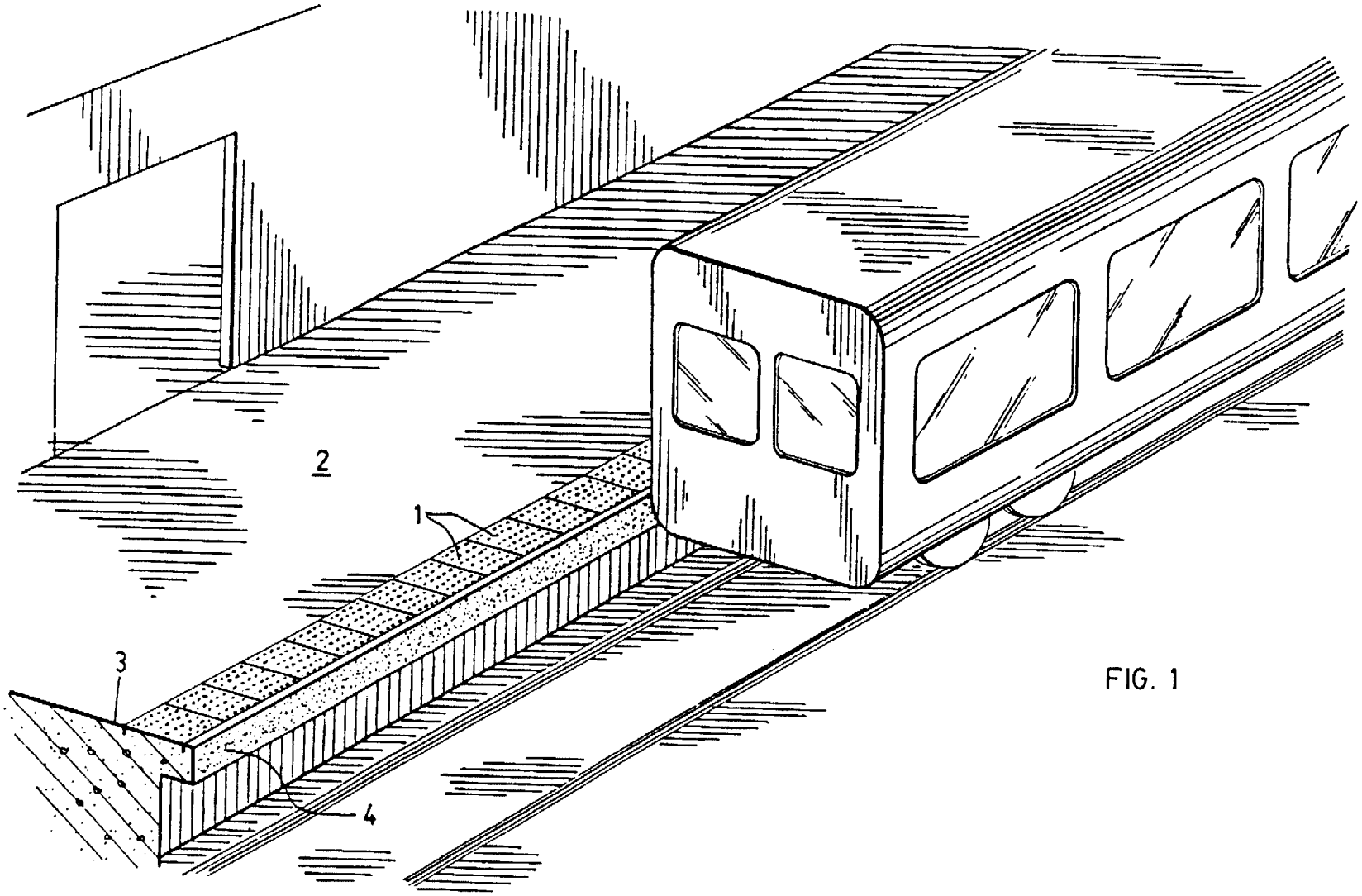
FIG. 1 is a perspective view showing the embedment tile of the present invention installed on a subway platform.
Figure 2:
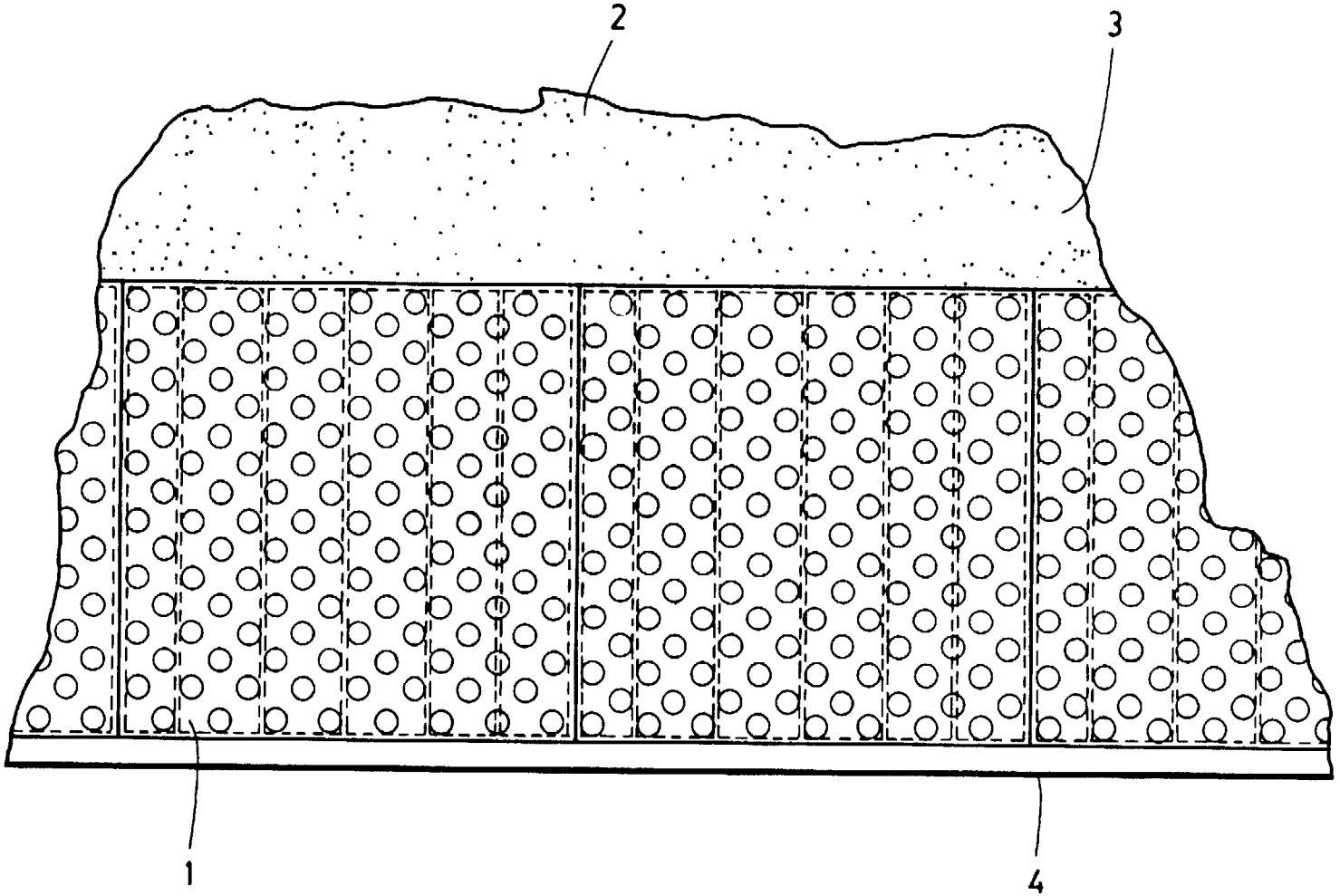
FIG. 2 is a top plan view of a enlarged section of the platform of FIG. 1 with the tiles of the present invention embedded in the concrete surface.

In FIGS. 1 and 2, tiles 1 of the present invention are shown embedded along the edge of a drop-off 4 in the surface 3 of a transit platform 2 . The ADA Guidelines prescribe the detectable warning at a platform edge shall have a width of 24" running the full length of the platform edge. Accordingly, the tiles 1 shown in FIG. 1 are illustrated as 24 inches square and are running the length of the platform unprotected by screens or guardrails. The tiles may be manufactured in other sizes as long as the installation complies with the regulations. For example, it is possible to manufacture in modules of three so that each tile is 24"×72" in order to reduce the time of installation.

Figure 3:
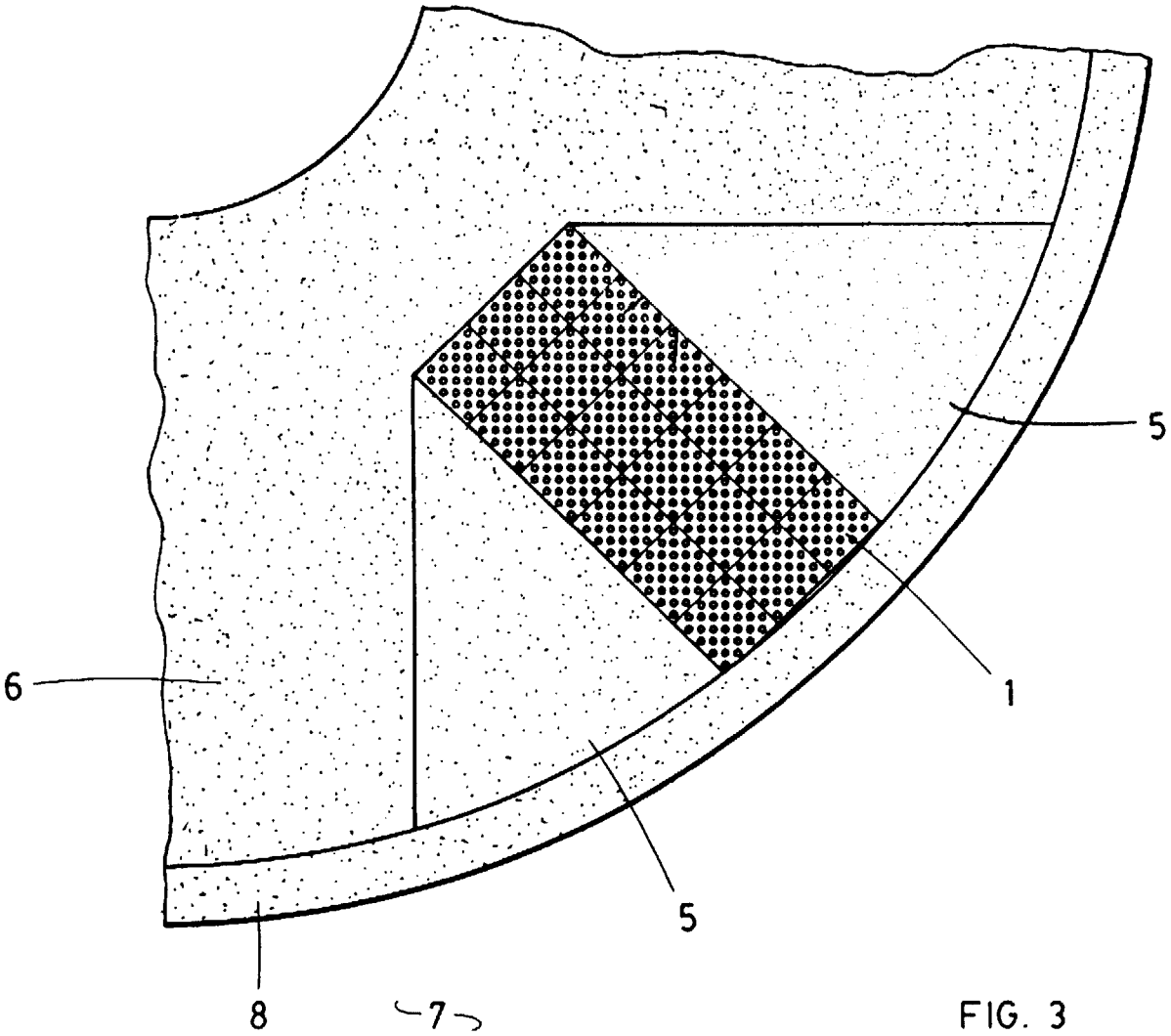
FIG. 3 is a top plan view of the tiles of the present invention embedded in concrete at a curb ramp.

In FIG. 3 the tiles 1 of the present invention are shown used as a detectable warning on a curb ramp 5. A pedestrian walkway 6 is separated from vehicular traffic on roadway 7 by curb 8. At a pedestrian crossing the walkway is sloped to form ramp 5 to street level to permit physically disabled persons easier access to the crossing. In order to permit the visually impaired to be appraised that a curb ramp is present and to orientate themselves to cross the roadway, the tiles of the present invention can be embedded into the surface of the ramp 5.

As best illustrated in FIGS. 4–8, tile 1 of the present invention has a generally horizontal top surface 10, opposite side edges 11 and front and rear edges 12 and 13 respectively. Vertical depending flanges 14 project downward from each of the opposite side edges 11 and front 12 and rear 13 edges of the tile 1. Additional internal vertical depending flanges 15 may be provided either diagonally or parallel to the side edges 11 of the tile to assist in anchoring the tile in the concrete. Preferably the internal flanges 15 are provided parallel to the side edges 11 and asymmetrically located, so that the tile can be cut between domes without cutting the domes and a perimeter flange is provided at the cut so that shorter lengths can be utilized as required. The flanges 14 and 15 have holes 16 through them to assist in anchoring the tile in the surface of the platform, commonly freshly poured concrete. By anchoring the tiles with the concrete through the holes the need for adhesives or mechanical fasteners which are labour intensive to install are eliminated or reduced. In addition by eliminating mechanical fasteners there are no holes in the top surface of the tile into which water can seep causing problems with degradation and freezing. The holes in the perimeter flanges 14 permit any trapped air to vent out the cells under the tiles parallel to the direction of travel when they are pressed into the concrete. In the preferred embodiment, the flanges 14 and 15 depend about 1¼" from the bottom surface 20 and holes 16 have a diameter of about ¾.

The top surface 10 of the tile 1 has a plurality of rows of spaced truncated domes 17 projecting upwardly therefrom, providing a distinctively textured surface relative to the texture of the surface of the platform. The truncated domes preferably are circular and comply with the ADA Accessibility Guidelines or are subject to an order for equivalent facilitation under those guidelines. Domes in adjacent rows are offset from each other by ½ of the centerline spacing distance. The domes 17 have generally flat upper surfaces which have textured means thereon for creating a relatively rough surface texture. The texturing means in the preferred embodiment is provided by rows of semi-circular raised dimples 18 arranged in a grid pattern.

The areas between domes preferably also are provided with a texturing means consisting of rows of spaced dimples 19 projecting upwardly therefrom to provide slip resistance in those areas. (Example: for women in high heels and improved manoeuvrability in wheel chairs).

To reduce the possibility of tripping the height of the domes in one or more rows adjacent the front edge 12 is reduced relative to the height of the domes in subsequent rows so that there is a gradual increase in height. In a preferred embodiment, the domes in the first row adjacent the front edge are only about ⅓rd as high as the domes in the main area. The domes in the second row are only about ⅔rds as high as the domes in the main area.

The tiles of the invention can be made of vinyl, rubber, urethane, ceramic or cast composite materials or the like. The detectable warning tiles preferably are made entirely of yellow thermoset glass reinforced plastic composite material having a textured surface pattern as described supra. In addition, a micro thin film may be applied to the upper surface, if desired, to provide enhanced abrasion resistance characteristics. The tiles are preferably made of a vitrified polymer composite and have the following characteristics:

1. Water Absorption and Bulk Density as per ASTM C373:
   a. 0.35 water absorption maximum allowable
   b. 2.25 bulk density minimum allowable
2. Abrasive Wear Index: Not less than 350 minimum when tested in accordance with ASTM C501.

3. Slip Resistance: not less than 0.80 minimum when tested in accordance with ASTM C1028.89
4. Accelerated Weather Test: There shall be no deterioration or fading and chalking of tile surface after 500 hours exposure when tested by ASTM G26, Method A
5. Rockwell Hardness: 70 Rockwell "E" minimum as tested by ASTM D785
6. Comprehensive Strength: 8,000 psi minimum as tested by ASTM D695
7. Tensile Strength: 6,000 psi minimum as tested by ASTM D695
8. Falling Ball Impact Resistance of tile when tested by ASTM D1037 to withstand a 2" steel ball dropped from a height of 50" without damage
9. Chemical Stain Resistance of tile when tested by ASTM D1037 to withstand without discolouration or staining—bleach solution, turpentine, iron oxide, ethane, soap solution, hydraulic oil, motor oil, carbon black, calcium chloride and ethylene glycol.

Because the entire tile preferably is brightly coloured it serves to visually alert sighted and visually impaired pedestrians in the vicinity of the subway platform edge. The textured surface provides a tactile signal as well which is particularly important for the visually impaired. The domes can be felt through most, if not all, footwear and can also be readily detected by a cane tap, frequently used by the blind or visually impaired.

Figure 4:
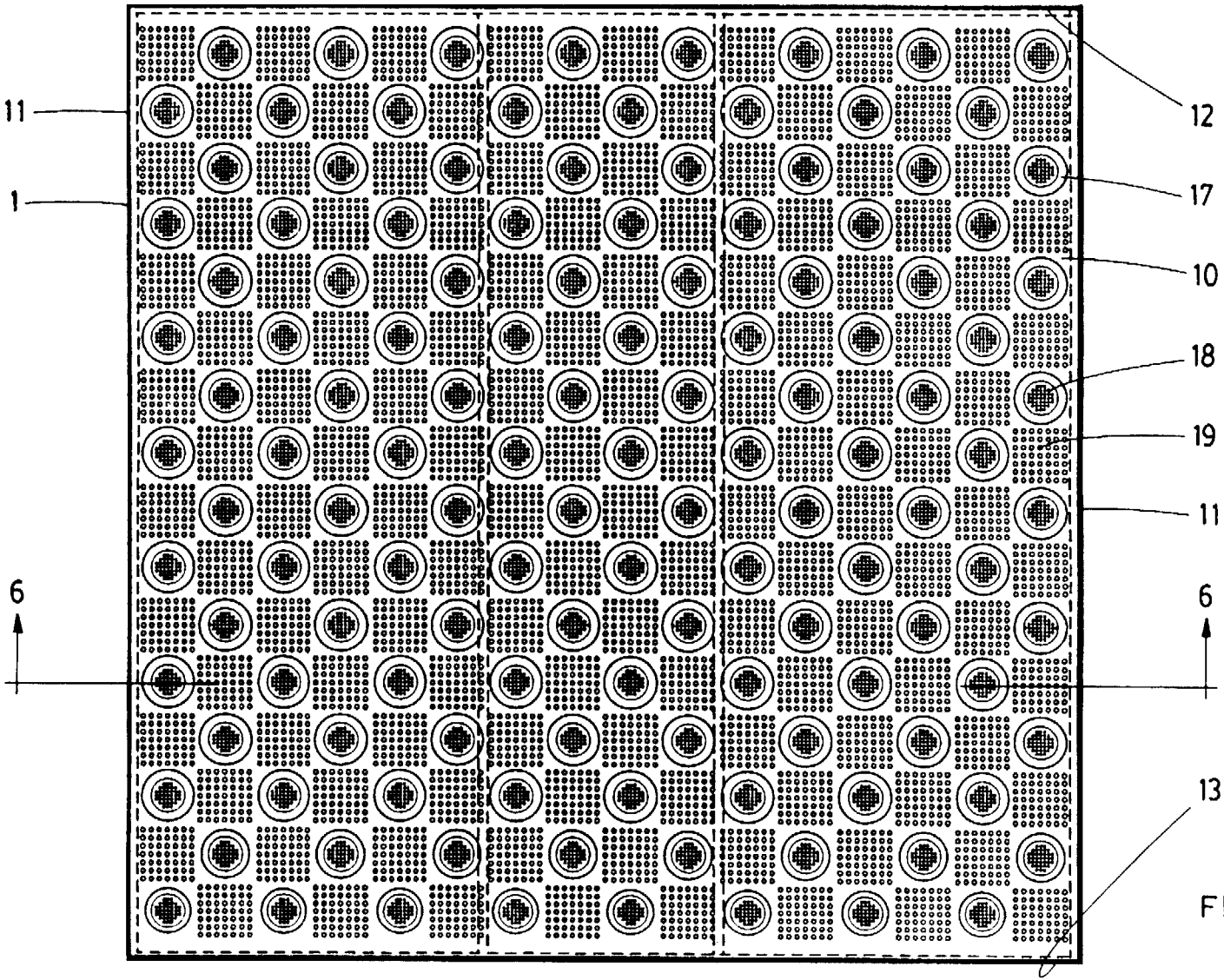
FIG. 4 is a top plan view of a square tile of the present invention.
Figure 5:
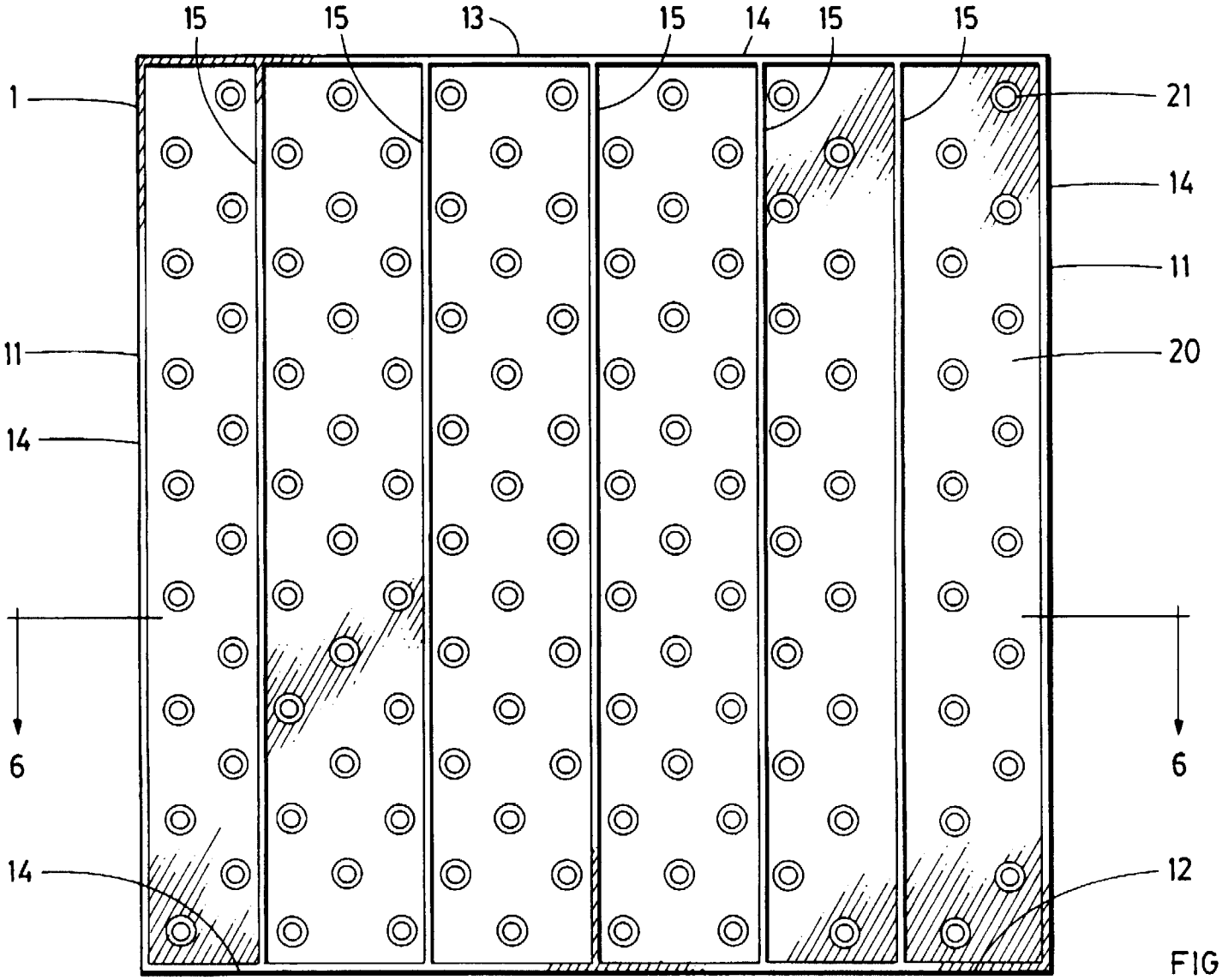
FIG. 5 is a bottom plan view of the tile in FIG. 3.

As best illustrated in FIG. 4, the bottom surface 20 of the tile 1 is provided with a series of projections 21. The projections 21 are preferably inverted truncated cones to simplify extraction from the mould during manufacture. As the tile is being pushed into the concrete the projections 21 assist in having the concrete flow underneath the tile and as the concrete cures and shrinks slightly the projections remain in contact with the cured surface of the concrete so that the tile is fully supported across its surface. During snow removal or cleaning, the tile will then support the weight of any heavy mechanical equipment and eliminate cracking of the tiles and their necessary replacement.

As the fresh concrete cures, an air space forms between the bottom surface 20 and the surface of the cured concrete. This air space prevents the load from equipment moved over the tiles from being transferred to the platform surface resulting in potential damage to the tiles. By incorporating the projections 21 into the bottom surface 20 the loads can be transferred to the platform or walkway surface through the conical standoffs. In the preferred embodiment the projections 21 are truncated cones about ¼" high. Adjacent the bottom surface 20 the projections have a diameter of about ⅝" and taper to a diameter of about ¼". However the airspace between the concrete surface and the bottom surface is not eliminated resulting in a hollow sound when struck by the cane of a visually impaired person. This distinct sound-on-cane contact between the tiles and the adjoining concrete surface permits the tiles to be used indoors in compliance with the ADA Guidelines. Where the tiles are bonded by an adhesive or mechanically fastened directly to the concrete surface it is not possible to get a distinctive sound-on-cane contact with a hard material of manufacture such as ceramic, glass reinforced thermosetting resin or vitrified polymer composite and softer resilient rubber or vinyl tiles must be used. In addition use of the projections 21 increases the surface area of the tile that is in contact with the cured concrete which helps resist movement due to thermal expansion etc.

Figure 6:
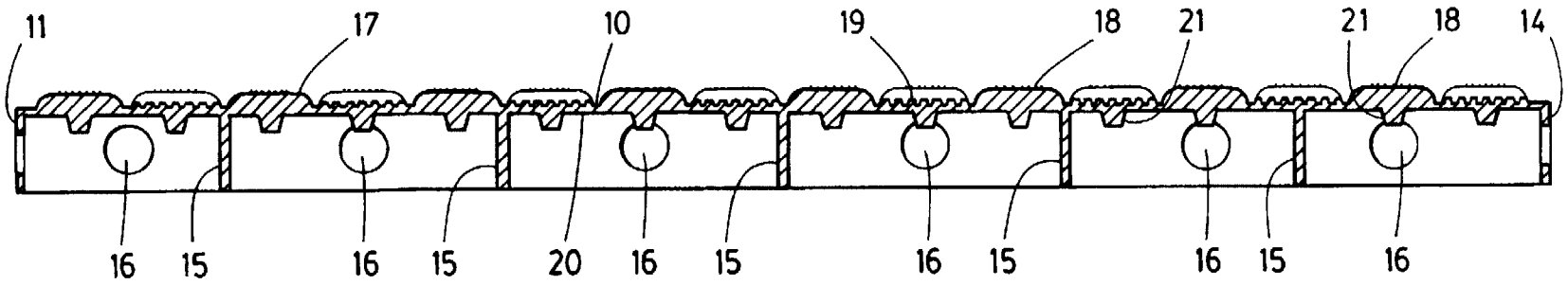
FIG. 6 is a cross-section through line AA in the tile of FIGS. 3 and 4.

FIG. 6 is a cross section of the tile of FIGS. 3 and 4 through line A—A. In the embodiment illustrated, the rows of inverted truncated domes 17 cover the top surface 10 of tile 1. The tile is shown as having nominal dimensions of 24"×24" and is provided with five parallel internal depending flanges 15 running from the front 12 to rear 13 edge. Holes 16 are provided in both the internal flanges 15 and the vertical depending flanges 14.

Figure 7:
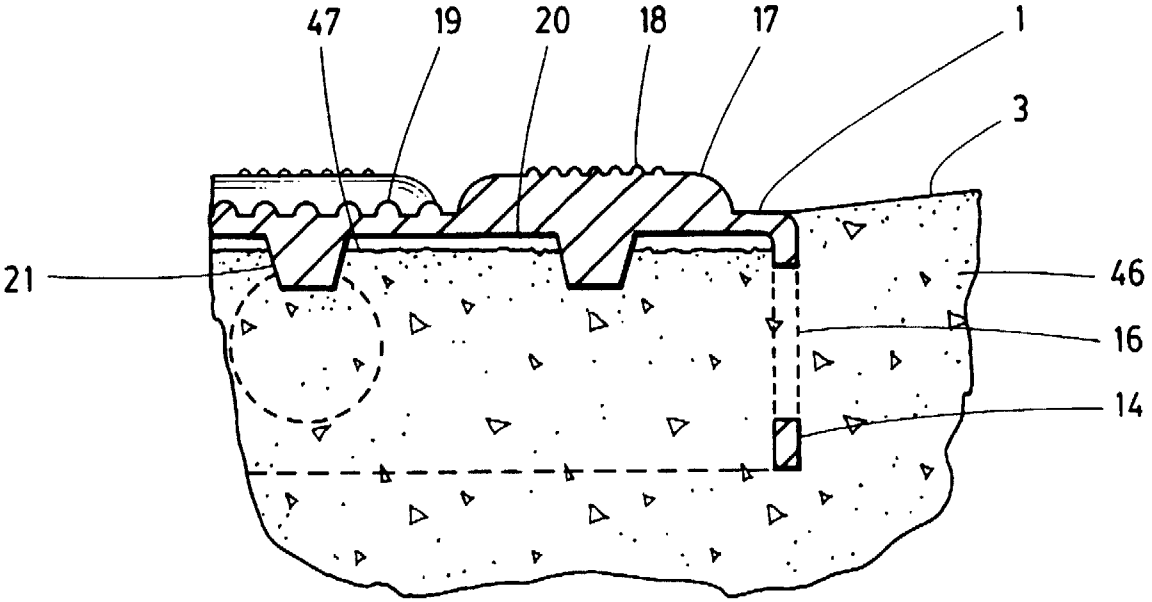
FIG. 7 is an enlarged partial cross-section of the tile of FIG. 3 embedded in the concrete.
Figure 8:
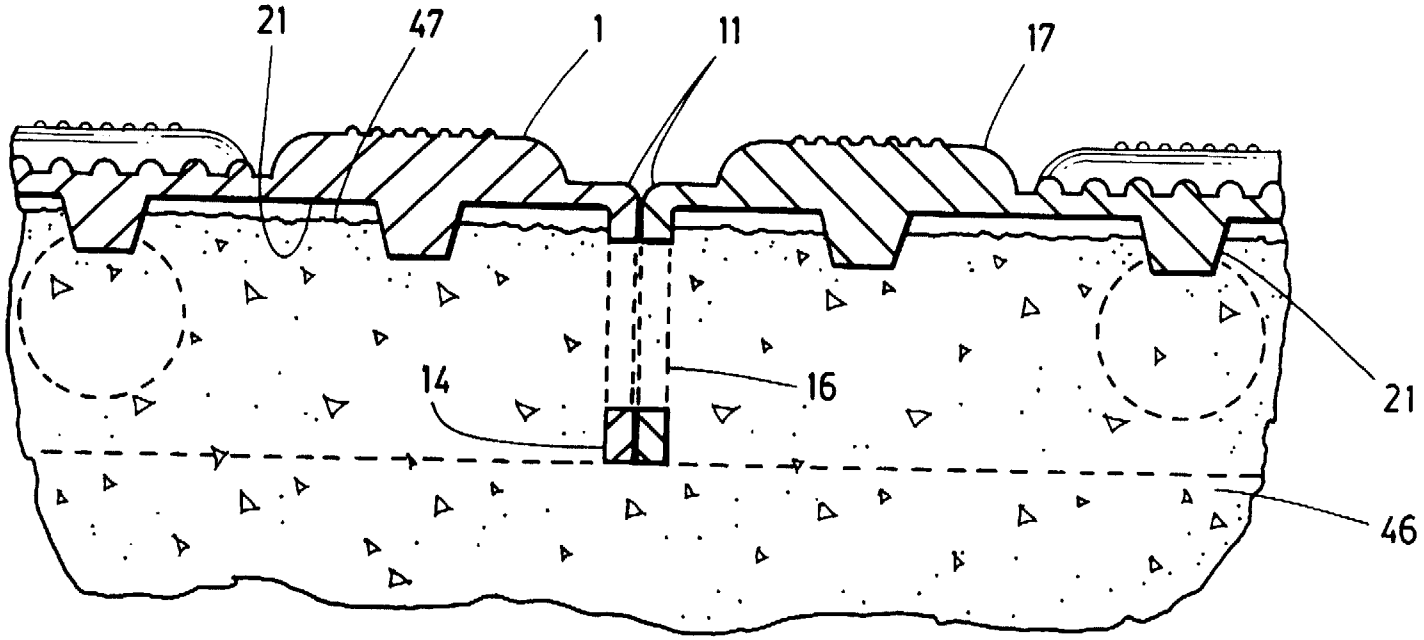
FIG. 8 is an enlarged partial cross-section of two adjoining tiles of FIG. 3 embedded in the concrete.

As shown in FIGS. 7 & 8, the tile 1 of the present invention is intended to be embedded in concrete or the like either by inserting it into freshly poured material or precast in pavers. When placed in freshly poured wet concrete 46 or the like, the tile is pushed down into the wet material until the top surface 10 is eat the same height as the adjacent platform surface 3. The concrete flows through holes 16 in the depending vertical flanges 14 & 15 helping to anchor the tile in place. The projections 21 are also pushed into the concrete displacing the concrete between projections to assist in filling in the space under the tile. As the concrete cures it shrinks slightly often leaving air pockets under the tile. When the tiles are cleaned, snow is removed or any other heavy equipment moves over the tiles, there is a chance for the tiles to crack or break in the areas where the concrete is not in contact with the bottom surface 20 of the tile. The projections 21 prevent tile from being unsupported as the projection depth is sufficient in most cases to remain in contact with the concrete or other material as it cures or dries. The projections 21 are spaced close enough together so that the tile is supported by are spaced far enough apart they do not adversely affect the ability to push the tile into the wet concrete which would be the case, if an extensive grid work of depending flanges was used. In addition the projections permit the tile to be supported without using an excess of the vitrified composite material reducing the cost relative to other types of support systems that may be contemplated. If the shape of the projections was changed so that the projections were inverted it would be possible to lock the tiles into the concrete as the distal end of the projection would be wider than the end connected to the bottom surface 20.

FIG. 7 shows two adjacent tiles embedded in concrete. The surface of the concrete under the tiles has cured unevenly and there is an air pocket between the tile and concrete. However projections 21 are of sufficient depth that they remain embedded in the concrete to support the tile. The tiles are intended to be embedded side by side with as little space as possible between tiles. In practice, the installer is unable to embedded the tiles tightly together so the joint between adjacent tiles should be filed with sealant to prevent tripping. A benefit of the space between tiles is that it can act as an expansion joint in areas where temperatures fluctuate substantially.

If the tile is used to fabricate concrete pavers, rebar can be inserted through the holes 16 in the depending flanges before pouring the concrete to provide strength to the pavers.

It will be appreciated that the above description related to the preferred embodiment by way of example only. Many variations on the invention will be obvious to those knowledgeable in the field, and such obvious variations are within the scope of the invention as described and claimed, whether or not expressly described.

What is claimed as the invention is:

1. A textured tile for embedment in fresh concrete on a platform or walking surface comprising a generally planar element with an upper surface and a bottom surface, said upper surface having a plurality of upper projections therefrom to provide a distinctive texture relative to the surface of the tile or walkway detectable by the visually impaired, said tile having two opposite side edges intended for alignment with corresponding side edges of other tiles, front and rear edges, at least one of which faces oncoming pedestrian traffic, vertical depending flanges along said opposite side edges and said front and rear edges, a plurality of holes in said depending flanges, each hole having a perimeter and a center, and wherein said depending flanges are adapted to be pressed into the fresh concrete so that any air trapped under said tile can escape through said holes in said flanges so that said flanges and said holes in the flanges anchor the tile to the concrete, and a plurality of truncated conical projections depending from the bottom surface of the generally planar element and extending below the perimeter of said holes but not extending below the center of said holes and wherein said truncated conical projections are of sufficient height to bridge any air space inadvertently formed between the surface of the fresh concrete after it has cured and the bottom surface of the generally planar element.

2. A textured tile according to claim 1 wherein the truncated conical projections are arranged in a series of parallel rows.

3. A textured tile according to claim 1 further including one or more additional vertical flanges depending from the bottom surface and located between said opposite side edges.

4. A textured tile according to claim 3 wherein said additional vertical flanges are parallel to said opposite side edges.

5. A textured tile according to claim 4 wherein said additional vertical depending flanges between opposite side edges are asymmetrically located so that the tile can be cut between upper projections without cutting the projections and a peripheral flange is provided along the cut.

6. A textured tile according to claim 1 wherein the truncated conical projections are about ¼" high.

7. A textured tile according to claim 1 wherein said vertical flanges are parallel to said opposite side edges.

* * * * *